US006139072A

United States Patent [19]

Lee

[11] Patent Number: 6,139,072

[45] Date of Patent: Oct. 31, 2000

[54] PUSH-PULL DOOR LOCK

[76] Inventor: Pyung-Kuk Lee, 244, Wallmoon 4-Ri, Wabu-Up Namyangju-Si Kyungki-do, Rep. of Korea

[21] Appl. No.: 09/415,190

[22] Filed: Oct. 7, 1999

[51] Int. Cl.[7] ..... E05C 1/12

[52] U.S. Cl. ..... 292/168; 292/336.3

[58] Field of Search ..... 292/165–168, 292/173, 92, 336.3

[56] References Cited

U.S. PATENT DOCUMENTS

| | | | |
|---|---|---|---|
| 1,022,624 | 4/1912 | Cook | 285/85 |
| 1,618,344 | 2/1927 | Kopp | 292/165 |
| 2,507,289 | 5/1950 | Williams | 292/167 |
| 2,895,322 | 7/1959 | Pollock | 292/166 |
| 3,477,754 | 11/1969 | Check | 292/165 |

*Primary Examiner*—B. Dayoan
*Assistant Examiner*—Gary Estremsky
*Attorney, Agent, or Firm*—Jeffrey L. Thompson; Thompson & Thompson, P.A.

[57] ABSTRACT

A push-pull door lock is disclosed. The push-pull door lock comprises a lock case installed within an installation hole of a door. A slider is slidably mounted within the lock case. A latch bolt is connected to the slider through an elastic member. A push member is slidably mounted to a first side of the lock case and operably connected to the slider by a first intermediation assembly so as to slide the slider. A pull member is slidably mounted to a second side of the lock case and operably connected to the slider by a second intermediation assembly so as to slide the slider. The first intermediation assembly comprises a push plate, a first slide projection and a push rod. The second intermediation assembly comprises a pull plate, a second slide projection and a pull rod. The push and pull plates are rotatably mounted around a fixing pin. The first and second slide projections are formed on the slider and are respectively in contact with the push and pull plates. The push and pull rods are respectively formed on the ends of the push and pull members.

1 Claim, 10 Drawing Sheets

PUSH-PULL DOOR LOCK

BACKGROUND OF THE INVENTION

1. Field of the Invention

The present invention relates, in general, to door locks and, more particularly, to a push-pull door lock allowing a door to be opened and closed by pushing or pulling a knob of the door.

2. Description of the Prior Art

As well known to those skilled in the art, a door having a conventional rotary door lock may be opened and closed by pushing or pulling a knob of the lock while the knob is rotated clockwise or counterclockwise.

FIGS. 10*a* and 10*b* are vertical sectional views, showing an operation of such a conventional rotary door lock. In the conventional rotary door lock, two knobs 81 are provided at the inside and outside of the door, and a spindle (not shown) is rotatably mounted between the knobs 81. A slider 83 is provided within the interior of the door so as to be slid by the projection 82 on the end of the spindle. A latch bolt 87 is connected to one side of the slider 83, with a bolt compression spring 88 being interposed between the latch bolt 87 and the slider 83. Two slider compression springs 86 are positioned between a case 85 and the other side of the slider 83 so that a restoring force of the slider compression springs 86 is exerted on the slider 83.

In a normal state, the latch bolt 87 is extended as shown in FIG. 10*a* and is inserted into the insertion recess of a doorframe (not shown), thereby keeping the door closed. When the door is desired to be opened, the knob 81 is rotated clockwise or counterclockwise, so that the projection 82 pushes the loop 84 of the slider 83, thereby removing the latch bolt 87 from the insertion recess. As shown in FIG. 10*b*, the door is opened by pushing or pulling the knob 81 while the latch bolt 87 is removed from the insertion recess. When the knob 81 is released, the slider 83 is returned to its original position by the restoring force of the slider compression springs 86.

However, according to the conventional rotary door lock, the following disadvantages occur.

Since such a door has to be opened while a knob of the door is rotated clockwise or counterclockwise, it is difficult for a medical patient, a child and a user with his both hands occupied to open the door. Since noise occurs while the knob is rotated, it is difficult to use the door lock in such a place in which silence is required. Additionally, since the projection of a spindle and the loop of a slider are worn out by friction between them, the door lock has a short life span.

SUMMARY OF THE INVENTION

Accordingly, the present invention has been made keeping in mind the above problems occurring in the prior art, and an object of the present invention is to provide a push-pull door lock allowing a door to easily be opened and closed by a medical patient, a child and a user with his both hands occupied.

Another object of the invention is to provide a push-pull door lock capable of making almost no noise.

A further object of the invention is to provide a push-pull door lock having a long life span.

In order to accomplish the above object, the present invention provides a push-pull door lock, comprising a lock case installed within an installation hole of a door, a slider slidably mounted within the lock case, a latch bolt connected to the slider through an elastic member, a push member slidably mounted to a first side of the lock case and operably connected to the slider by a first intermediate assembly so as to slide the slider, and a pull member slidably mounted to a second side of the lock case and operably connected to the slider by a second intermediate assembly so as to slide the slider.

The first intermediation assembly may comprise a push plate, a first slide projection and a push rod, and the second intermediation assembly may comprise a pull plate, a second slide projection and a pull rod, said push and pull plates being rotatably mounted around a fixing pin, said first and second slide projections being formed on said slider and being respectively in contact with said push and pull plates, said push and pull rods being respectively formed on the ends of said push and pull members.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
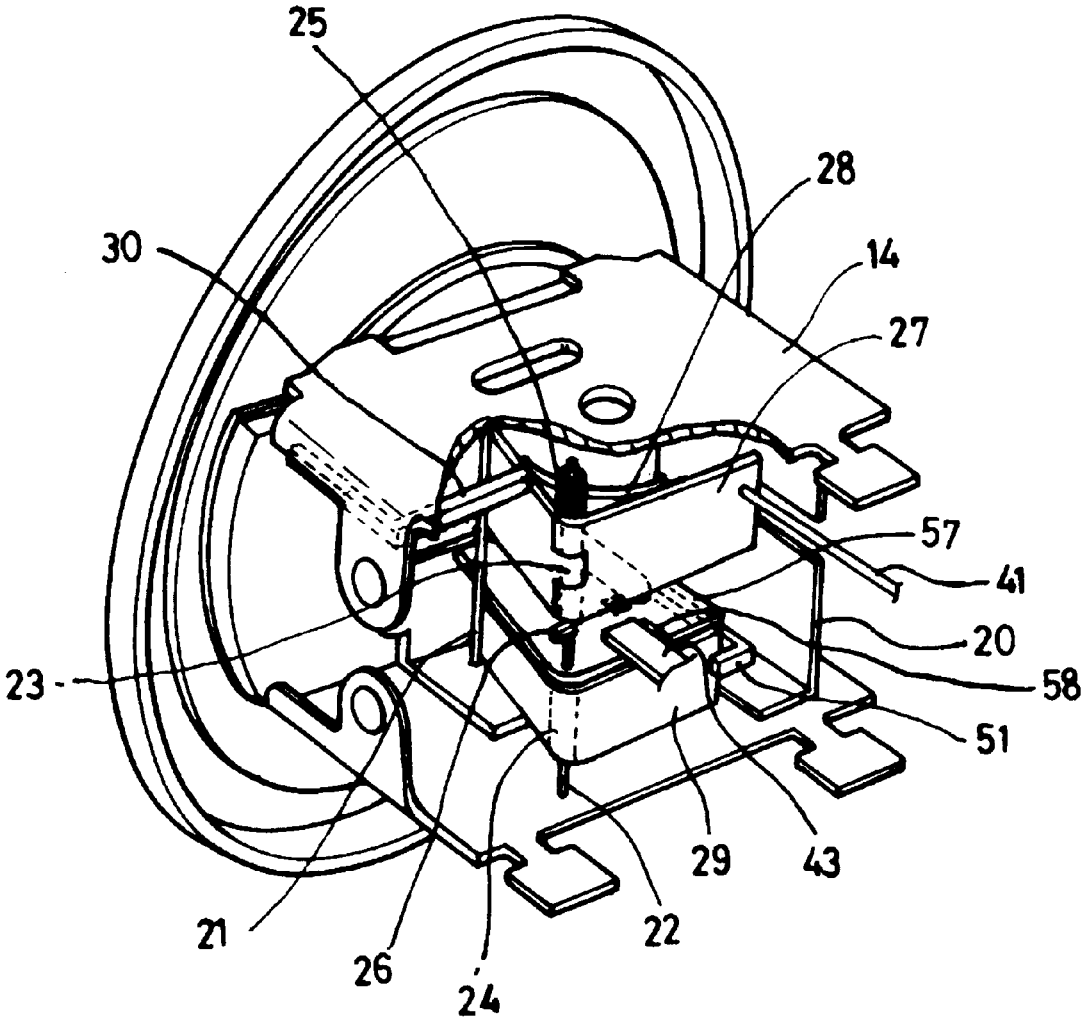
FIG. 1 is a partially cutaway perspective view, showing the construction of a push-pull door lock according to the preferred embodiment of this invention.

Construction of a push-pull door lock according to the preferred embodiment of this invention is described in the following.

An installation groove is formed in a door 11, the door 11 being hinged on a wall (not shown). A lock case 14 is installed within the installation groove. A slider 20 is provided within the lock case 14, and a latch bolt 16 is connected to a side of the slider 20 through an elastic member 15.

A fixing pin 22 is vertically provided in the case 14. A first rotating pin 23 is provided in the upper portion of the fixing pin 22, the first rotating pin 23 being rotatable and movable in a vertical direction. A V-shaped push plate 27 is fixed around the first rotating pin 23. A spring 25 is positioned around the fixing pin 22 between the first rotating pin 23 and the upper plate of the case 14. A stopper 26 is provided around the fixing pin 22 at a position where the fixing pin 22 meets the first rotating pin 23. A plate spring 28 is positioned near to the inside of the push plate 27. A second rotating pin 24 is provided in the lower portion of the fixing pin 22, the second rotating pin 24 being rotatable and movable in a vertical direction. A V-shaped pull plate 29 is fixed around the second rotating pin 24.

A slider projection 21 is formed at the inside of the slider 20 so as to be pushed by ends of the push and pull plates 27 and 29 to slide the slider 20.

A limiting rod 30 is provided above the push plate 27 to limit the upward movement of the push plate 27.

A push member 40 is slidably mounted to one side of the lock case 14, a first holding projection 42 being formed at the inner portion of the push member 40 so as to prevent the push member 40 from being removed from the case 14, and a push rod 41 is formed at the inner end of the push member 40 so as to push the push plate 27.

A pull member 50 is slidably mounted to the other side of the case 14, a second holding projection 42 being formed at the inner portion of the pull member 50 so as to prevent the pull member 50 from being removed from the case 14, and a pull rod 51 is formed at the inner end of the pull member 50 so as to pull the pull plate 29. A locking assembly is provided through the pull member 50. The locking assembly consists of a locking button 53, a locking rod 54 and an elastic spring 56, the locking button 53 being exposed out of the pull member 50, the locking rod 54 being inserted into the pull member 50 and having two locking projections 55 at its inner end portion, the elastic spring 56 being seated around the inner portion of the locking rod 54.

With regard to the exposed portions of the push member 40 and the pull member 50, the exposed portions of the push member 40 and the pull member 50 may have various shapes, such as, a bulb, a square pillar or a triangle pillar and have a short length so as to reduce an occupied space.

General operation of the push-pull door lock according to the embodiment will be described in the following.

Figure 2:
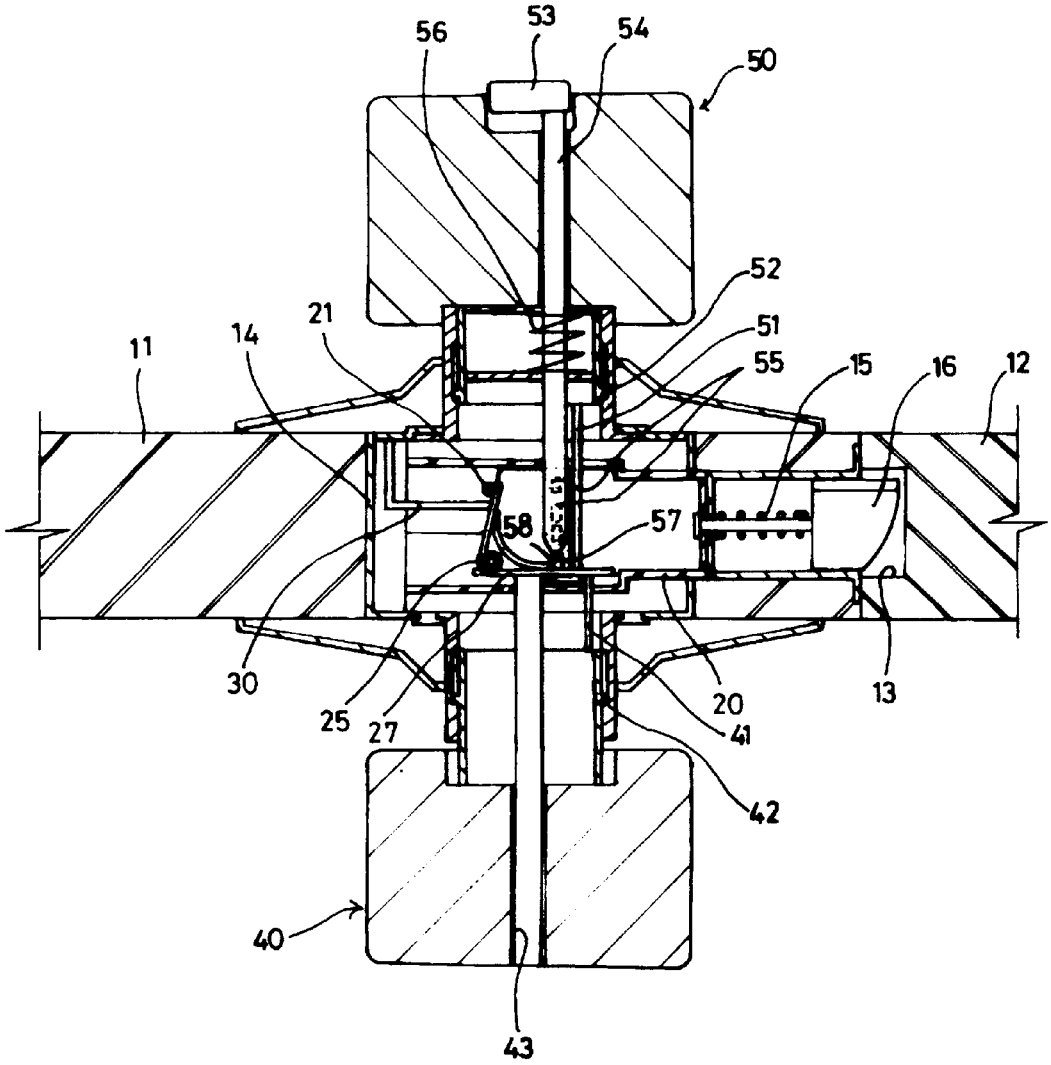
FIG. 2 is a transverse sectional view, showing the installation of the push-pull door lock of FIG. 1.

As shown in FIGS. 1 and 2, in a normal state, the latch bolt 16 is inserted into the recess of the doorframe 12 by the action of the elastic member 15, so that the door 11 is maintained closed. When the door 11 is desired to be opened, the push member 40 has to be pushed or the pull member 50 has to be pulled.

Figure 3:
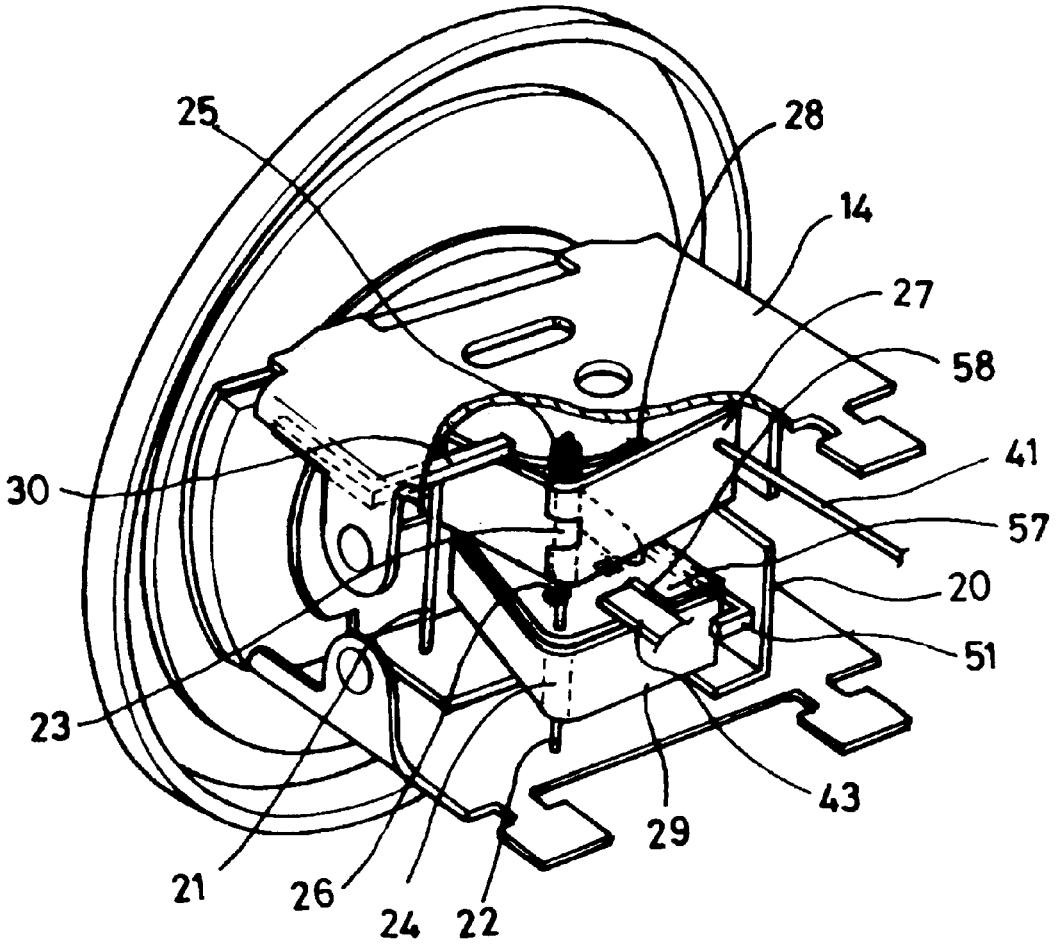
FIG. 3 is a partially cutaway perspective view, showing the construction of the push-pull door lock with a push member pushed.
Figure 4:
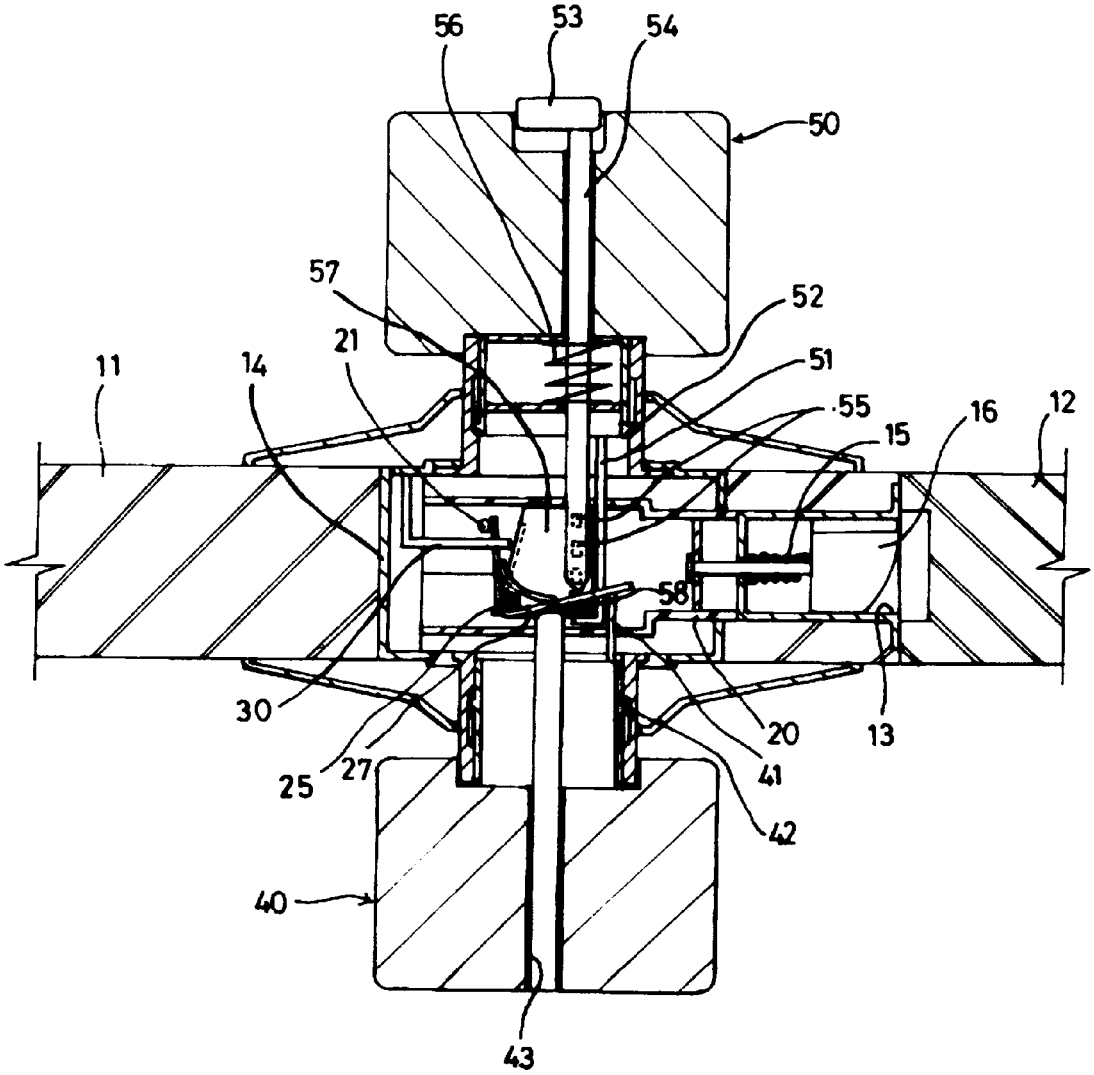
FIG. 4 is a transverse sectional view, showing the installation of the push-pull door lock of FIG. 3.
Figure 5:
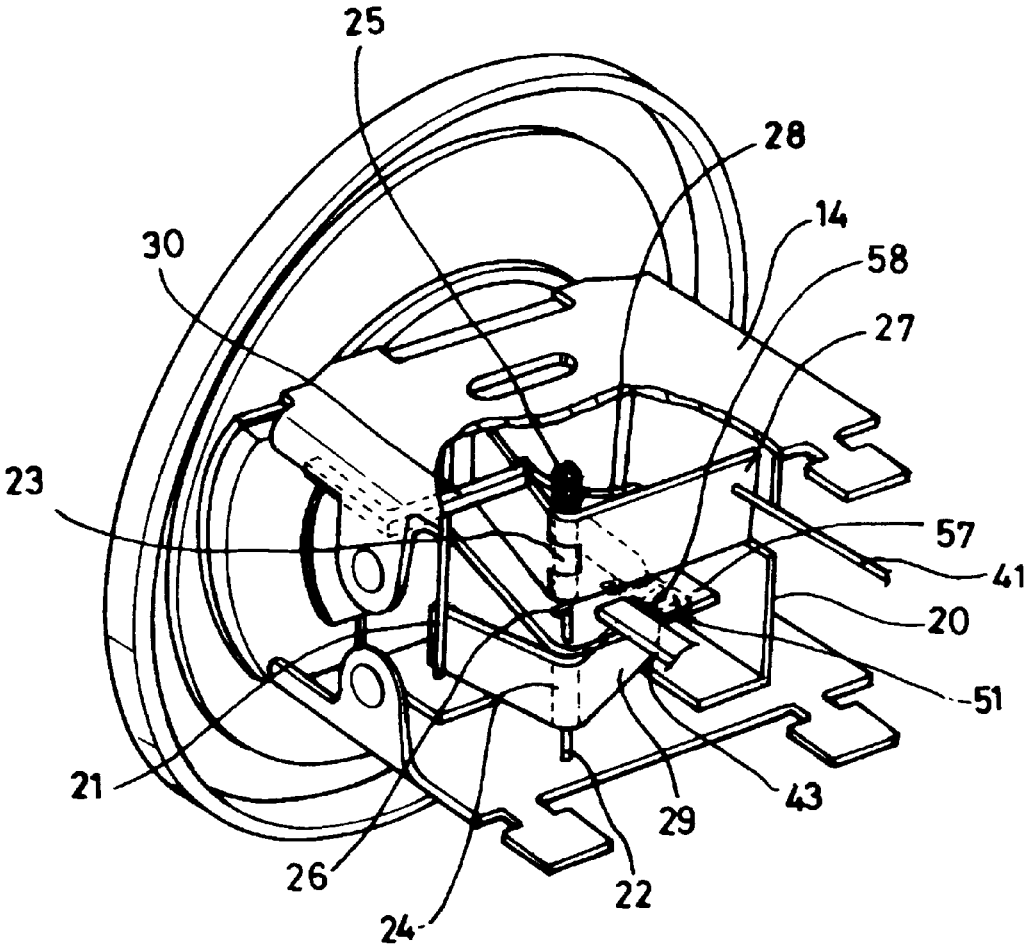
FIG. 5 is a partially cutaway perspective view, showing the construction of the push-pull door lock with a pull member pulled.
Figure 6:
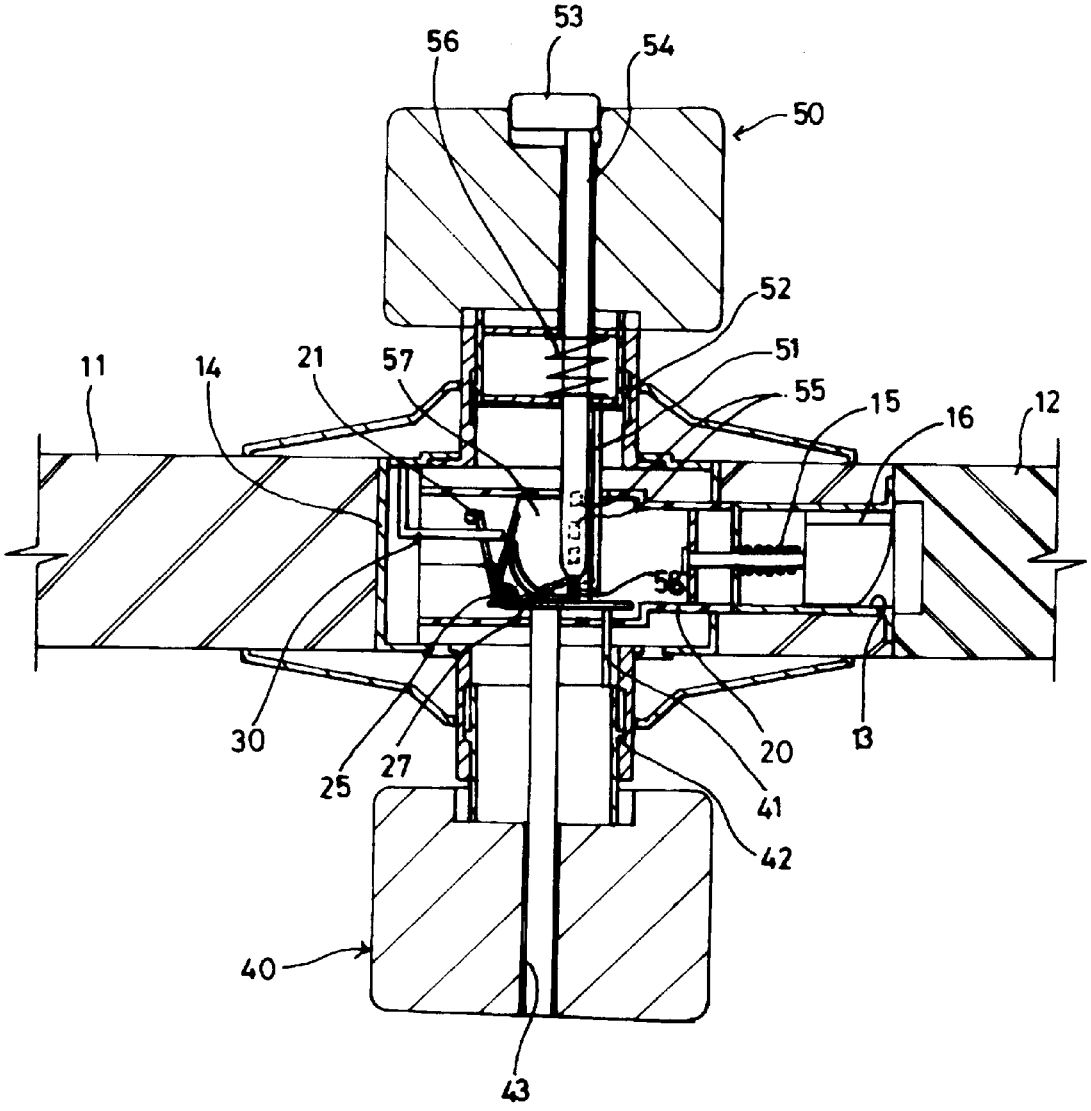
FIG. 6 is a transverse sectional view, showing the installation of the push-pull door lock of FIG. 5.

As shown FIGS. 3 and 4, when the push member 40 is pushed, the push plate 27, which was in contact with the push rod 41 of the push member 40, is rotated by the push rod 41. Subsequently, a slider projection 21 is pushed by the push plate 27, so that the slider 20 slides to the left direction on the basis of FIG. 4. Finally, the latch bolt 16, which is connected to the slider 20 through the elastic member 15, is removed from the recess of the doorframe 12. At this time, when the push member 40 is pushed more, the door 11 may be opened. After that, when the push member 40 is released, the slider 20 is returned to its original position by the action of the elastic member 15. A first portion of the slider projection 21 which is contacted by the push plate 27 and connected to the slider 20 is referred to herein as a first slide projection. The push plate 27, the first slide projection, and the push rod 41 are referred to collectively herein as a first intermediation assembly that operably connects the push member 40 to the slider 20.

On the other hand, when the pull member 50 is pulled, the pull plate 29, which was in contact with the pull rod 51 of the pull member 50, is rotated by the pull rod 51. Subsequently, the slider projection 21 is pulled by the pull plate 29, so that the slider 20 slides to the left direction on the basis of FIG. 4. Finally, the latch bolt 16, which is connected to the slider 20 through the elastic member 15, is removed from the recess of the doorframe 12. At this time, when the pull member 50 is pulled more, the door 11 may be opened. After that, when the pull member 50 is released, the slider 20 is returned to its original position by the action of the elastic member 15. A second portion of the slider projection 21 which is contacted by the pull plate 29 and connected to the slider 20 is referred to herein as a second slide projection. The pull plate 29, the second slide projection, and the pull rod 51 are referred to collectively herein as a second intermediation assembly that operably connects the pull member 50 to the slider 20.

Locking operation will be described in the following.

In a normal state, the door 11 may be opened by pushing the push plate 27 with a push rod 41 or pulling the pull plate 29 with a pull rod 51.

Figure 7:
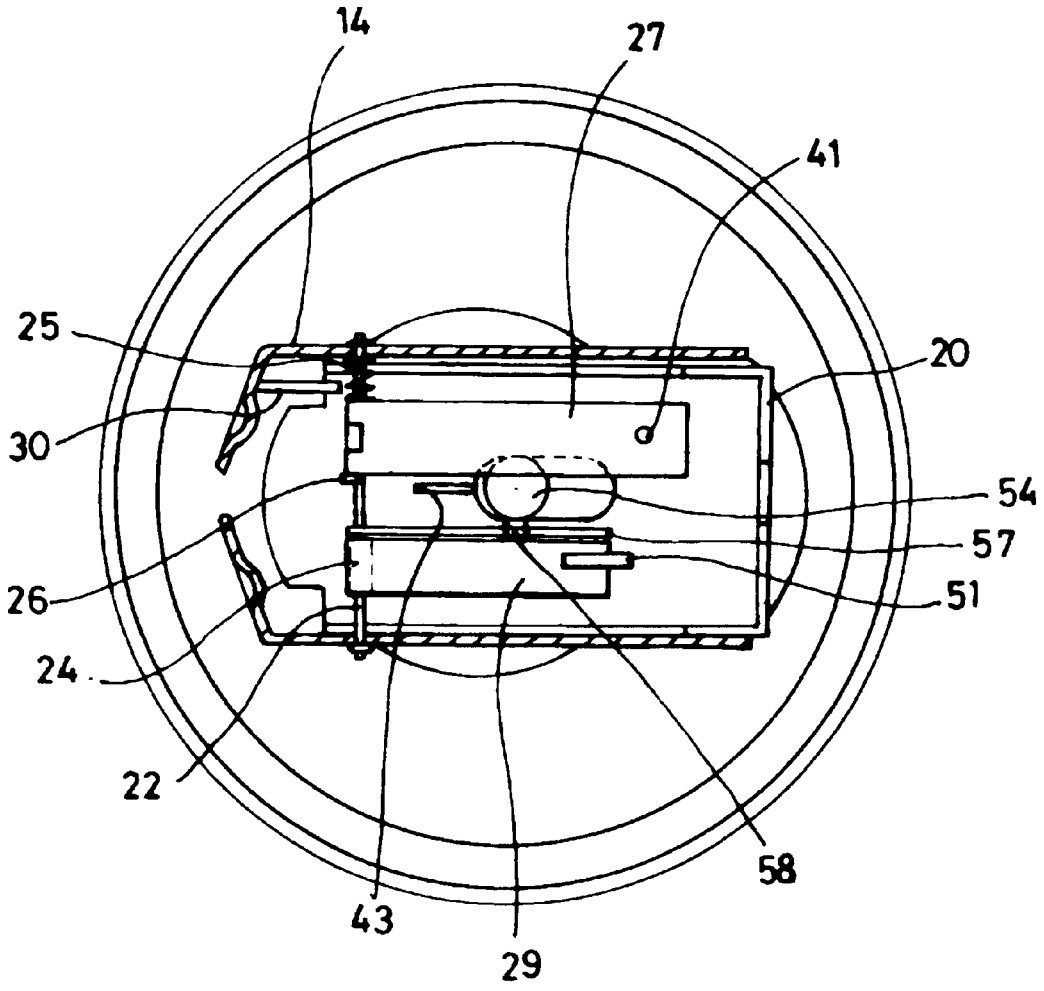
FIG. 7 is a vertical sectional view, showing the construction of the push-pull door lock according to the embodiment.
Figure 8:
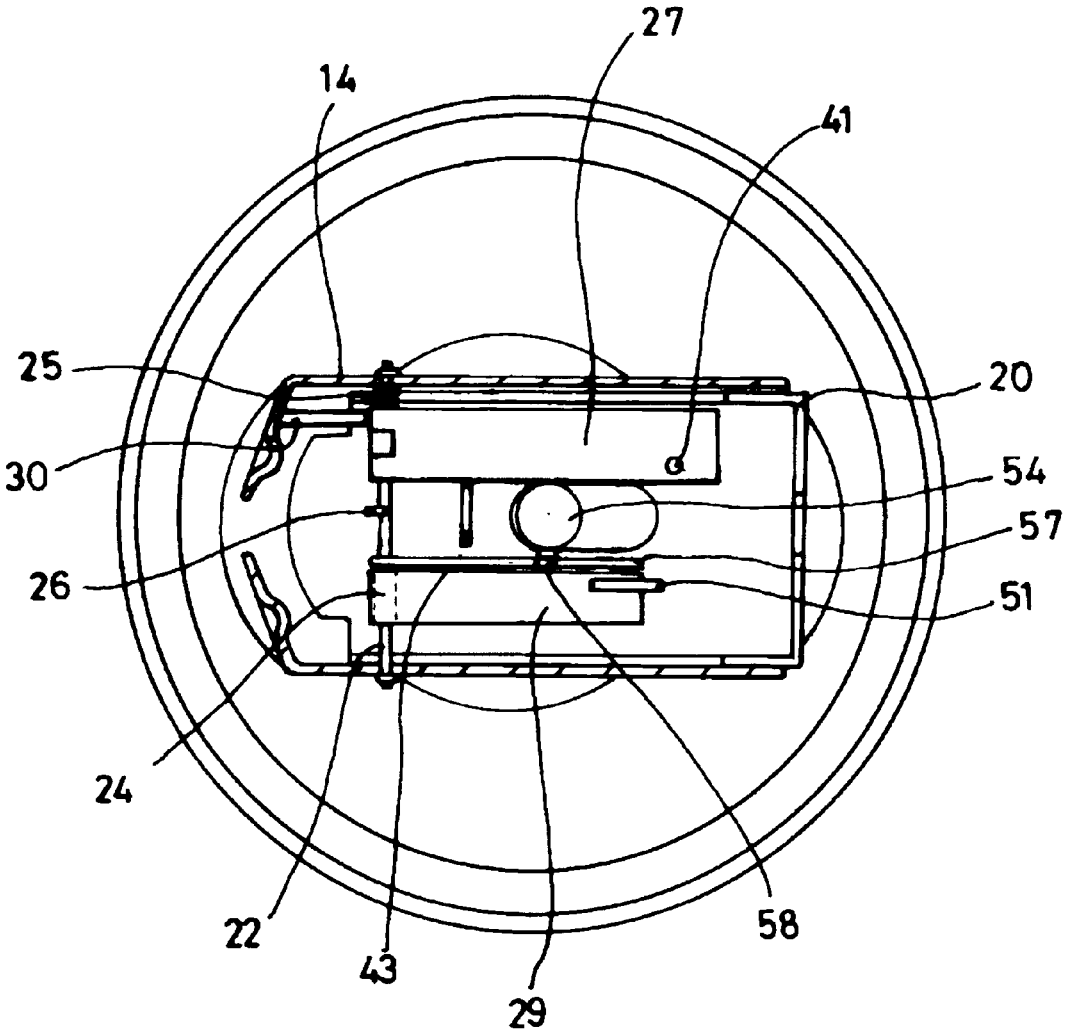
FIG. 8 is a vertical sectional view, showing the construction of the push-pull door lock according to the embodiment while the door is locked by a key via a keyhole.

When the door 11 is desired to be locked from the outside of the door 11, a key is rotated after being inserted into the keyhole 43. The push plate 27 is raised by such a manipulation as shown in FIG. 8, thereby coming into contact with the limiting rod 30. Therefore, when the push member 40 is pushed, the push plate 27 is not moved, so that the door 11 is not opened. At this time, when the key is rotated in a reverse direction after being inserted into the keyhole 43, the push plate 27 is returned to the original position by the action of the spring 28, as shown in FIG. 7.

Figure 9:
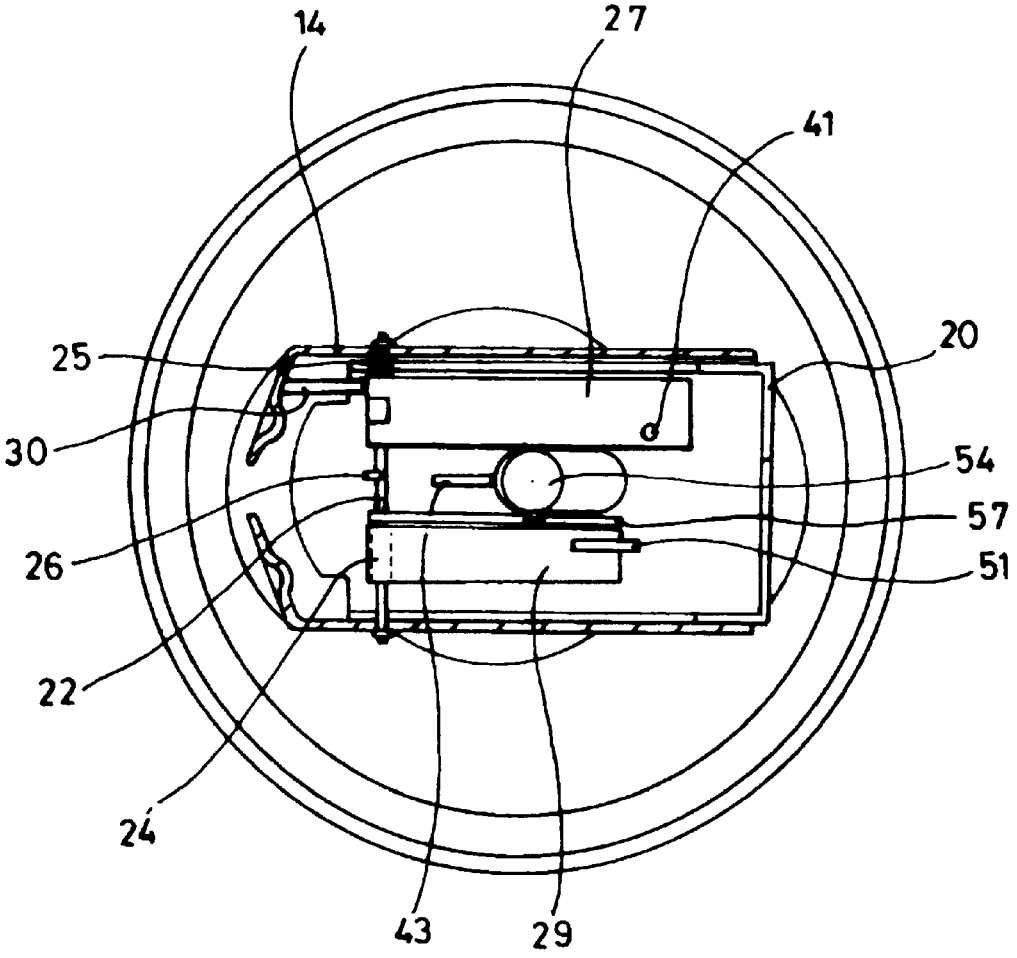
FIG. 9 is a vertical sectional view, showing the construction of a push-pull door lock according to the embodiment while the door is locked by a locking button.
Figure 10A:
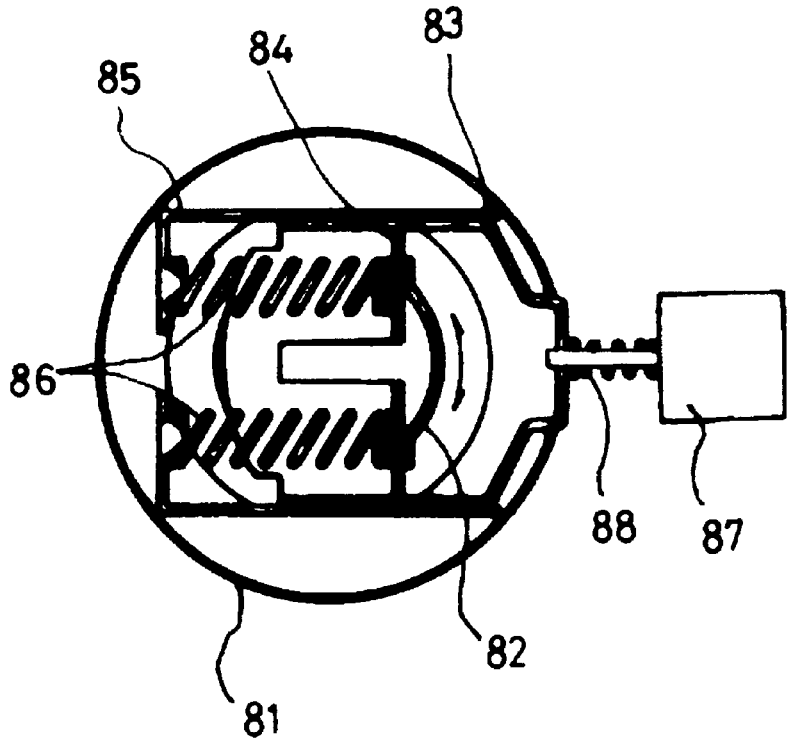
Fig. 10a (Prior Art)
FIG. 10*a* is a vertical sectional view, showing the construction of a conventional rotary door lock while a door is closed.
Figure 10B:
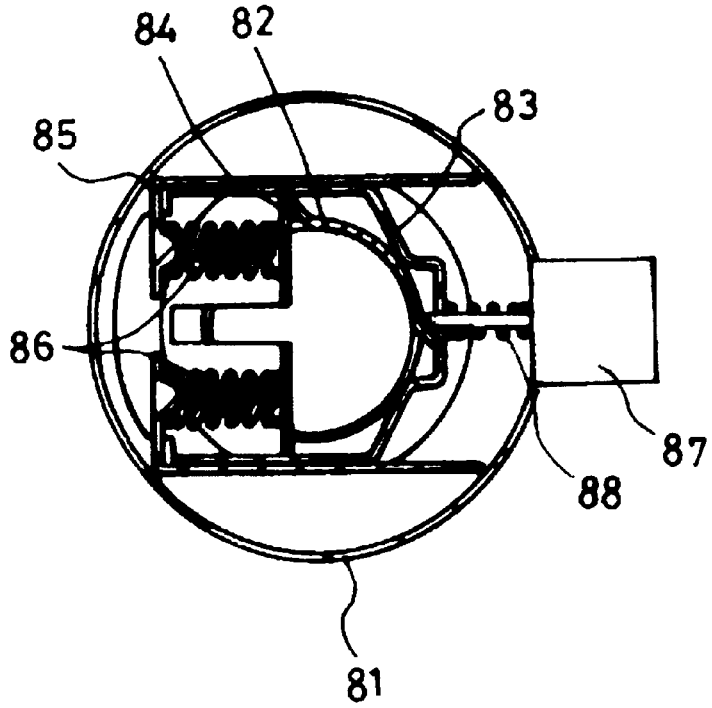
Fig. 10b (Prior Art)
FIG. 10*b* is a vertical sectional view, showing the construction of the conventional rotary door lock while the door is opened.

When the door 11 is desired to be locked from the inside of the door 11, the locking button 53 is pushed. As shown in FIG. 9, the push plate 27 is raised by the locking rod 54 connected to the locking button 53 and, simultaneously, the locking projection 55 of the locking rod 54 is inserted into and engages with the locking recess 58 of the locking plate 57. Therefore, when the push member 40 is pushed, the push plate 27 is not moved, so that the door 11 is not opened. At this time, when the pull member 50 is pulled, the locking projection 55 of the locking rod 54 is removed from the locking recess 58 of the locking plate 57 and the push plate 27 is returned to the original position by the action of the spring 28, as shown in FIG. 7.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A push-pull door lock, comprising:

a lock case installed within an installation hole of a door;

a slider slidably mounted within said lock case;

a latch bolt connected to said slider through an elastic member;

a push member slidably mounted to a first side of said lock case and operably connected to said slider by a first intermediation assembly so as to slide said slider; and a pull member slidably mounted to a second side of said lock case and operably connected to said slider by a second intermediation assembly so as to slide said slider;

wherein said first intermediation assembly comprises a push plate, a first slide projection and a push rod, and said second intermediation assembly comprises a pull plate, a second slide projection and a pull rod, said push and pull plates being rotatably mounted around a fixing pin, said first and second slide projections being formed on said slider and being respectively in contact with said push and pull plates, said push and pull rods being respectively formed on the ends of said push and pull members.

* * * * *